US010730727B2

(12) United States Patent
Knapp

(10) Patent No.: US 10,730,727 B2
(45) Date of Patent: Aug. 4, 2020

(54) LOW PROFILE DROP TABLE

(71) Applicant: BBM Railway Equipment, LLC, Youngstown, OH (US)

(72) Inventor: Ryan W. Knapp, Sandy Hook, CT (US)

(73) Assignee: BBM Railway Equipment, LLC, Youngstown, OH (US)

( * ) Notice: Subject to any disclaimer, the term of this patent is extended or adjusted under 35 U.S.C. 154(b) by 550 days.

(21) Appl. No.: 14/454,318

(22) Filed: Aug. 7, 2014

(65) Prior Publication Data

US 2016/0039646 A1 Feb. 11, 2016

(51) Int. Cl.

| | |
|---|---|
| ***B66F 3/46*** | (2006.01) |
| ***B66F 7/28*** | (2006.01) |
| ***B66F 7/08*** | (2006.01) |
| ***B66F 7/06*** | (2006.01) |

(Continued)

(52) U.S. Cl.

CPC ..... *B66F 3/46* (2013.01); *B61K 5/00* (2013.01); *B66F 3/22* (2013.01); *B66F 7/065* (2013.01); *B66F 7/0666* (2013.01); *B66F 7/0675* (2013.01); *B66F 7/08* (2013.01); *B66F 7/28* (2013.01)

(58) Field of Classification Search

CPC .... B66F 7/08; B66F 7/065; B66F 7/28; B66F 7/0675; B66F 7/0658; B66F 7/0683; B66F 7/0666; B66F 3/22; B66F 3/28; B66F 3/46; B66F 7/0608; B66F 7/0691; B66F 7/20; B60F 7/08; B61K 5/00

USPC ..... 187/211, 204, 203, 216, 218, 219, 269; 254/122, 89 H, 124–126, 89 R, 90, 91; 104/32.1

See application file for complete search history.

(56) References Cited

U.S. PATENT DOCUMENTS

| | | | | |
|---|---|---|---|---|
| 819,592 A * | 5/1906 | Phillips | ..... | B61K 5/00 104/32.1 |
| RE16,989 E | 6/1928 | Waters | | |

(Continued)

FOREIGN PATENT DOCUMENTS

| | | |
|---|---|---|
| CN | 202989714 U | 6/2013 |
| DE | 9108825 U1 * | 7/1991 |

(Continued)

OTHER PUBLICATIONS

Hunter Pit Racks for Heavy-Duty Trucks and Buses; Copyright 2010. Hunter Engineering Company.*

(Continued)

*Primary Examiner* — Monica S Carter
*Assistant Examiner* — Mahdi H Nejad
(74) *Attorney, Agent, or Firm* — Fay Sharpe LLP

(57) ABSTRACT

A lifting apparatus having two rails spaced apart at a distance and two lifting mechanisms, each lifting mechanism supporting one of the two rails. A platform is disposed between the two rails such that movement of the lifting mechanisms causes the rails to displace relative to the platform. A base has the two lifting mechanisms connected thereto and the platform is connected to the base. The base moves horizontally along a floor. Further, the floor may be disposed in a pit and the travel of the rails between minimum and maximum rail heights may be greater than 62.5% of the depth of the pit. The minimum rail height may be less than 50% of the depth of the pit.

9 Claims, 8 Drawing Sheets

(51) Int. Cl.
*B61K 5/00* (2006.01)
*B66F 3/22* (2006.01)

(56) References Cited

U.S. PATENT DOCUMENTS 1,706,211 A * 3/1929 Coffey ..... B61K 5/00 100/290
1,748,696 A * 2/1930 Austin ..... H02G 15/06 174/19
1,772,848 A * 8/1930 Walsh ..... B61K 5/00 104/32.1
1,802,592 A * 4/1931 Christie ..... B61K 5/00 104/32.1
1,847,719 A * 3/1932 Hirschel ..... B60S 5/00 187/204
1,859,830 A * 5/1932 Reinhold ..... B66F 3/22 182/141
2,111,917 A * 3/1938 Minty ..... B61K 5/00 104/32.1
2,178,632 A * 11/1939 Holmes ..... B61K 5/00 104/32.1
2,178,851 A * 11/1939 Dodge ..... F16N 5/02 222/262
2,191,710 A * 2/1940 Fones ..... B61K 5/00 104/32.1
2,196,468 A * 4/1940 Minty ..... B61K 5/00 104/32.1
2,454,225 A * 11/1948 Skinner ..... B61K 5/00 104/32.1
2,454,226 A * 11/1948 Skinner ..... B61K 5/00 104/32.1
2,640,435 A 6/1953 Griffiths
2,652,784 A 9/1953 Holmes et al.
2,655,115 A * 10/1953 Holdeman ..... B61K 5/00 104/32.1
2,718,851 A 9/1955 Holdeman
3,367,449 A * 2/1968 Pelouch ..... B66F 7/18 187/205
3,393,772 A * 7/1968 Pelouch ..... B66F 7/18 187/205
3,558,103 A * 1/1971 Lodige ..... B66F 7/0625 254/122
3,563,345 A * 2/1971 MacMillan ..... B66F 7/26 187/204
3,931,895 A * 1/1976 Grimaldo ..... B60P 3/07 414/495
4,447,042 A * 5/1984 Masui ..... B66F 7/0641 187/204
4,491,194 A * 1/1985 Mountz ..... B66F 7/28 187/204
4,624,448 A * 11/1986 Lawman ..... B66F 3/245 254/122
5,215,287 A * 6/1993 Leski ..... B66F 3/22 254/122
5,285,992 A * 2/1994 Brown ..... B66F 7/0608 108/147
5,370,058 A * 12/1994 David ..... B61K 5/04 104/32.1
5,404,968 A * 4/1995 Fletcher ..... B66F 7/14 187/205
5,694,864 A * 12/1997 Langewellpott ..... B66F 7/065 108/145
6,186,279 B1 * 2/2001 Blocker ..... B66F 7/0641 187/206
6,257,371 B1 * 7/2001 Wanner ..... B66F 7/20 187/204
7,886,380 B2 * 2/2011 Hornbach ..... A47C 19/045 5/613
7,900,562 B2 * 3/2011 Esposti ..... B61K 5/04 104/32.1
9,045,149 B2 * 6/2015 Knapp ..... B61J 1/04
9,764,934 B2 * 9/2017 Knapp ..... B66F 1/06
10,000,221 B2 * 6/2018 Knapp ..... B61K 13/00
2006/0026762 A1 * 2/2006 Hornbach ..... A47C 19/045 5/611
2007/0051932 A1 * 3/2007 Ha ..... B66F 3/22 254/122
2008/0224107 A1 * 9/2008 Polins ..... B66B 9/16 254/45
2011/0240409 A1 * 10/2011 Bacon ..... B66F 7/065 187/269
2012/0048653 A1 * 3/2012 Matthews ..... B66F 7/08 187/211
2012/0313059 A1 * 12/2012 Litcher ..... B66F 3/22 254/122
2015/0166313 A1 * 6/2015 Knapp ..... B66F 7/025 254/89 R
2016/0052757 A1 * 2/2016 De Jong ..... B66F 3/24 254/89 H
2017/0030092 A1 * 2/2017 Young ..... E04F 21/00

FOREIGN PATENT DOCUMENTS

DE 102004027215 A1 * 6/2004
DE 102009025493 A1 * 6/2009
DE 202011104094 U1 * 7/2011
EP 0501254 A2 * 2/1992
EP 2731901 B1 * 7/2012
JP H07157292 A 6/1995
JP 2004268837 A 9/2004

OTHER PUBLICATIONS

Hunter P441 and P444 Alignment Pit System; Copyright 2015. Hunter Engineering Company.*
Hunter Pit Racks for passenger cars and light trucks; Copyright 2017. Hunter Engineering Company.*
Hunter Pit Racks for Heavy-Duty Trucks and Buses; Copyright 2017. Hunter Engineering Company.*
Hunter PF Heavy Duty Alignment Pit System; Copyright 2015. Hunter Engineering Company.*
Hatfield (Moose Jaw Yard Visir: Wheels Drop Table; Published on Jun. 25, 2014).*
Railquip1 (Drop Table Railquip, Published on Nov. 30, 2011).*
Railquip2 Truck Drop Table Exchange Systems Railquip; Published on Dec. 2, 2011).*
Drop Tables; www.Whiting.ca https://www.handling.com/assets/assets/solutions/drop-tables-2/033fab57db/Drop-Tables.pdf (Year: 2009).*
Macton Shallow Pit Scissor Lift Drop Tables http://www.macton.com/shallow-pit-scissor-lift-drop-table/ (Year: 2019).*

* cited by examiner

LOW PROFILE DROP TABLE

FIELD OF THE INVENTION

The present invention relates to lifting and positioning machinery, more particularly, the present invention relates to low profile railway drop tables.

BACKGROUND OF THE INVENTION

Drop tables are generally known in the art, but suffer from a number of disadvantages. Examples of known drop tables are shown and described in U.S. Pat. No. 2,718,851 to Holdeman and U.S. Pat. No. 2,652,784 to Holmes.

Holdeman discloses an apparatus for removing and replacing the wheels of a passenger car that operates in a pit intersecting a service track over which vehicles may run. As disclosed, for convenience and safety of the workmen, the table is closed between the rails by a floor plate. Holdeman further discloses an air based lifting mechanism Holmes discloses another drop table where rails are positioned at a fixed distance above a working platform where the working platform and rails move up and down allowing for removal of trucks, axle assemblies and the like. Holmes further discloses a vertical screw based lifting mechanism.

CN202989714, relates to a railway maintenance vehicle having a scissor type mechanism for moving a working platform 22 up and down.

Due to the configuration of these lifting devices, pits must often be larger than about 6 feet deep. Typically, the deeper the pit, the more dangerous the pit is considered. In many cases, government regulating bodies such as OSHA (Occupational Saftey and Health Administration) regulate pits in factories and repair shops based on depth. For example, additional fall prevention safeguards may be required for pits larger than six feet in depth. In addition, some rail yards may be located in areas where soil moisture content progressively increases as the pit depth increases. At increasing depths, there may be too much water content or even ground water present which inhibits proper installation of a machinery pit.

Further, many drop tables may be positioned in a pit with multiple parallel track sections passing through the pit. Therefore, the machinery may need a traversing function that allows it to move between the different track sections for installation and/or removal of various parts such as axles. The use of rails in the bottom of the pit further increases requirements for pit depth as the height of the rails must be added to the clearance requirements for the machinery so that the machinery can drop far enough down into the pit for appropriate repair and replacement operations to be completed.

SUMMARY OF THE INVENTION

It is therefore an object of the invention to provide a lifting apparatus that utilizes a relatively shallow pit depth for easier installation, a more compact footprint and lower danger relative to older designs.

It is yet another object of the invention to provide a lifting apparatus that has a thinner profile in comparison to older designs.

It is still another object of the invention to provide a lifting apparatus that allows for easier installation.

It is yet a further object of the invention to provide a lifting apparatus that can be installed at sites where prior art lifting apparatuses could not be installed due to soil, ground water and/or water table constraints.

These and other objects are achieved by providing a lifting apparatus including two rails spaced apart at a distance and two lifting mechanisms, each lifting mechanism supporting one of the two rails. A platform is disposed between the two rails such that movement of at least one of the lifting mechanisms causes at least one of the rails to displace relative to the platform. The apparatus may further include a base, the two lifting mechanisms connected to the base, and the platform connected to the base. The base is adapted to move horizontally along a floor.

In one aspect the two rails each define a top surface and the apparatus may further include two lower surfaces located below and between the top surfaces and a support extending between said two lower surfaces. A support mechanism may be connected to the support on one end, the support mechanism moving between extended and retracted positions to cause vertical displacement of another end of the support mechanism in relation to the support.

In other aspects the support mechanism includes a column and a gearbox rotatable by a drive wherein rotation of the gearbox causes vertical displacement of the column. A first distance is measured vertically between a top surface of at least one the two rails and the platform when the lifting mechanism is in a lowered position. The column may be dimensioned such when the column is in a first position a lower end of the column extends below the two rails at a second distance less than the first distance.

In other aspects the support mechanism includes a threaded member rotatable by a drive, the threaded member having two threaded blocks threaded therearound such that rotation of the threaded member causes a distance between the two threaded blocks to change. Two support links may be rotatable about one of the two threaded blocks. The support links may be connected to each other at a medial portion of the support links such that displacement of the threaded blocks causes the support links to rotate in opposing directions. A block mechanism may be connected to a block at one end and connected to the support links such that rotation of the support links causes vertical displacement of the block. The block mechanism may further include third and fourth support links connected to the block at the one end of the block mechanism and each connected to one end of one of the two support links. The block mechanism may further include fifth and sixth support links respectively connected to the third and fourth support links and rotatable with respect to each other at a rotation connection. A column may extend from the block to a sliding joint, the sliding joint coupled to the rotation connection such that vertical displacement of the block causes said column to slide within the sliding joint.

In other aspects, the lifting apparatus includes a track positioned below the base such that the base moves along the track and the floor is positioned in a pit. The track may be recessed into the floor such that wheels associated with the base extend at least partially below the floor.

In other aspects a minimum rail height is measured as the distance between the floor and a top of at least one of the two rails when the two rails are at a bottom position. A depth is measured from the floor to a top of a fixed rail wherein the fixed rail is located above the floor. A maximum rail height is measured as the distance between the floor and a top of at least one of the two rails when the two rails are at a top position. A travel is defined as the difference between the maximum and minimum rail heights. In some aspects the minimum rail height is less than 50% of the depth. In some aspects the travel is greater than 62.5% of the depth.

Other objects are achieved by providing a lifting apparatus having two rails spaced apart at a distance and two lifting mechanisms, each lifting mechanism supporting one of the two rails. A platform may be disposed between the two rails such that movement of at least one of the lifting mechanisms causes at least one of the rails to displace relative to the platform. The two lifting mechanisms may each include: two links joined to each other in a medial section by a pivot; and a rotating pivot located at one end of each of said two links, another end of each of the two links having a sliding connection such that rotation of the two links about their respective rotating pivots causes the sliding connections to move relative to the rotating pivots to cause vertical displacement of the pivot.

In some aspects the lifting apparatus includes a secondary linkage having two arms joined at a first hinge on one end and connected to one of the two links at their respective other ends, wherein connection of the two arms at their respective other ends connects to the respective one of the two links between the one end of the two links and the pivot. A linear displacement device may be connected to the pivot and the first hinge such that displacement of the linear displacement device causes a distance measured between the first hinge and the pivot to change.

In other aspects, the two rails each define a top surface. Two lower surfaces may be located below and between the top surfaces. A support may extend the two lower surfaces. A support mechanism may be connected to the support on one end, the support mechanism moving between extended and retracted positions to cause vertical displacement of another end of the support mechanism in relation to the support.

In other aspects the support mechanism includes a column and a gearbox rotatable by a drive wherein rotation of the gearbox causes vertical displacement of the column. A first distance may be measured vertically between a top surface of at least one the two rails and said platform when the lifting mechanism is in a lowered position. The column may be dimensioned such when the column is in a first position a lower end of the column extends below the two rails at a second distance less than the first distance.

In other aspects, the support mechanism includes a threaded member rotatable by a drive, the threaded member having two threaded blocks threaded therearound such that rotation of the threaded member causes a distance between the two threaded blocks to change. Two support links may each be rotatable about one of the two threaded blocks. The support links may be connected to each other at a medial portion such that displacement of the threaded blocks causes the support links to rotate in opposing directions. A block mechanism may be connected to a block at one end and connected to the support links such that rotation of the support links causes vertical displacement of the block.

In other aspects a track may be positioned below the base such that the base moves along the track and the floor is positioned in a pit. The track may be recessed into the floor such that wheels associated with the base extend at least partially below the floor.

The block mechanism may further include third and fourth support links connected to the block at the one end said block mechanism and each connected to one end of one of the two support links. Fifth and sixth support links may be respectively connected to the third and fourth support links and rotatable with respect to each other at a rotation connection. A column may extend from the block to a sliding joint, the sliding joint coupled to the rotation connection such that vertical displacement of the block causes the column to slide within the sliding joint.

Other objects are achieved by providing a lifting apparatus including two rails spaced apart at a distance and two lifting mechanisms, each lifting mechanism supporting one of the two rails. A platform may be disposed between the two rails such that movement of at least one of the lifting mechanisms causes at least one of the rails to displace relative to the platform. A base may have the two lifting mechanisms connected thereto, where the platform may be connected to the base. The base may be adapted to move horizontally along a floor. The two lifting mechanisms may each include: two links joined to each other in a medial section by a pivot; and a rotating pivot located at one end of each of the two links, another end of each of the two links having a sliding connection such that rotation of the two links about their respective rotating pivots causes the sliding connections to move relative to the rotating pivots to cause vertical displacement of the pivot.

In some aspects the two lifting mechanisms further comprise: a secondary linkage having two arms joined at a first hinge on one end and connected to one of the two links at their respective other ends, wherein connection of the two arms at their respective other ends connects to the respective one of the two links between the one end of the two links and the pivot; and a linear displacement device connected to the pivot and the first hinge such that displacement of the linear displacement device causes a distance measured between the first hinge and the pivot to change.

In some aspects the two rails each define a top surface two lower surfaces may be located below and between the top surfaces. A support may extend between the two lower surfaces. A support mechanism may be connected to the support on one end, the support mechanism moving between extended and retracted positions to cause vertical displacement of another end of the support mechanism in relation to the support.

In some aspects, the support mechanism includes one or more of: a column; a gearbox rotatable by a drive wherein rotation of the gearbox causes vertical displacement of the column; a first distance measured vertically between a top surface of at least one said two rails and said platform when said lifting mechanism is in a lowered position; the column dimensioned such when the column is in a first position a lower end of said column extends below the two rails at a second distance less than the first distance.

In other aspects, the support mechanism may include a threaded member rotatable by a drive, the threaded member having two threaded blocks threaded therearound such that rotation of the threaded member causes a distance between the two threaded blocks to change. Two support links may be each rotatable about one of the two threaded blocks. The support links may be connected to each other at a medial portion such that displacement of the threaded blocks causes the support links to rotate in opposing directions. A block mechanism may be connected to a block at one end and connected to the support links such that rotation of the support links causes vertical displacement of the block.

In other aspects the block mechanism includes third and fourth support links connected to the block at the one end said block mechanism and each connected to one end of one of the two support links. Fifth and sixth support links may be respectively connected to the third and fourth support links and rotatable with respect to each other at a rotation connection. A column may extend from the block to a sliding joint, the sliding joint coupled to the rotation connection such that vertical displacement of the block causes the column to slide within the sliding joint.

In other aspects the lifting apparatus includes a track positioned below the base such that the base moves along the track and the floor is positioned in a pit. The track may be recessed into the floor such that wheels associated with the base extend at least partially below the floor.

In other aspects a minimum rail is height measured as the distance between the floor and a top of at least one of the two rails when the two rails are at a bottom position. A depth is measured from the floor to a top of a fixed rail wherein the fixed rail is located above the floor. A maximum rail height is measured as the distance between the floor and a top of at least one of the two rails when the two rails are at a top position. A travel is defined as the difference between the maximum and minimum rail heights. In some aspects the minimum rail height is less than 50% of the depth. In some aspects the travel is greater than 62.5% of the depth.

Other objects of the invention and its particular features and advantages will become more apparent from consideration of the following drawings, claims and accompanying detailed description. It is still further contemplated that it may be advantageous, depending upon the application, to utilize all or any portion of the functions or combinations of functions described herein.

DETAILED DESCRIPTION OF THE INVENTION

Figure 1:
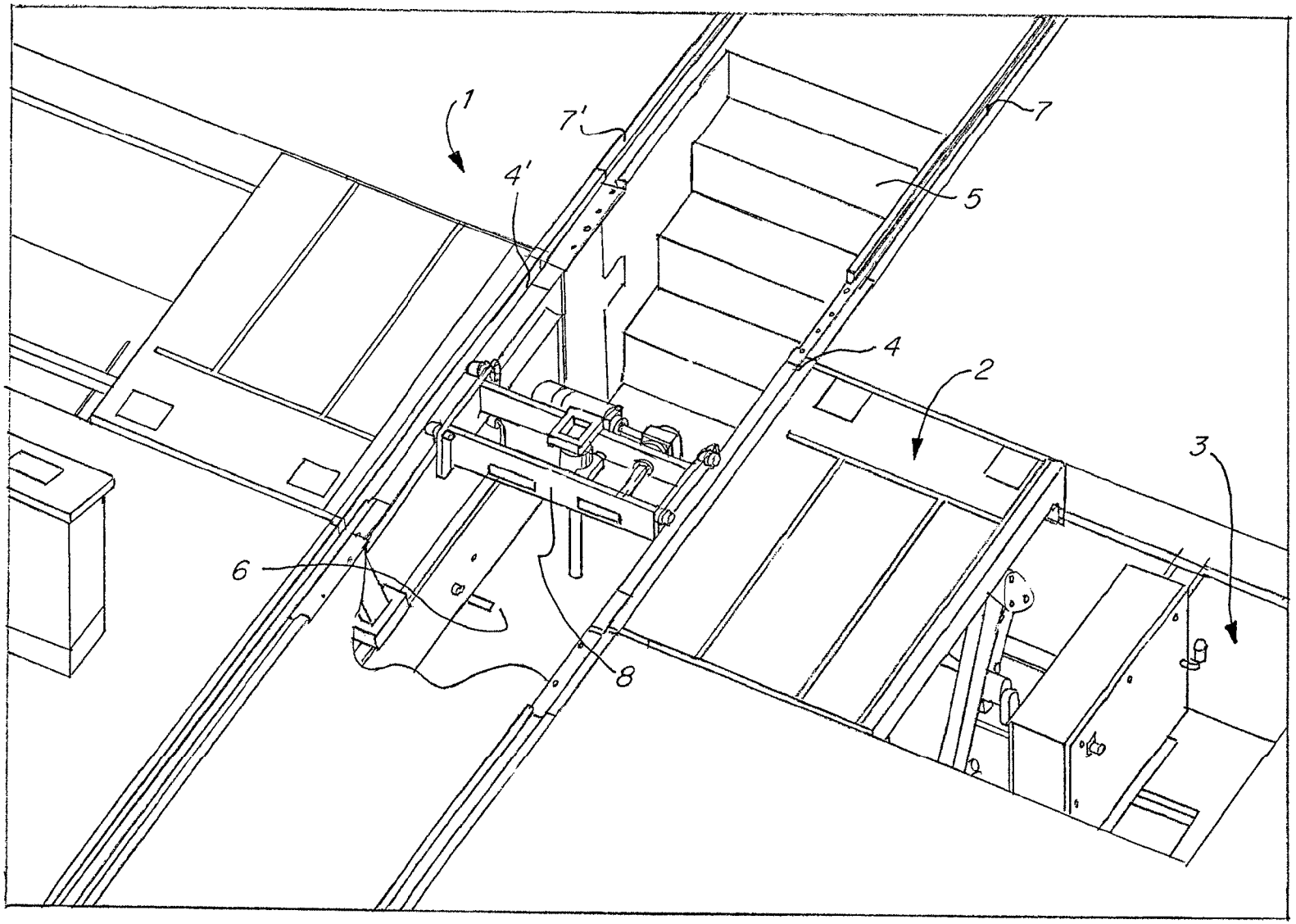
FIG. 1 is a perspective view of a lifting apparatus installed at a site according to the present invention

Referring now to the drawings, wherein like reference numerals designate corresponding structure throughout the views. In FIG. 1, a lifting apparatus 2 is shown installed in a pit 3. The lifting apparatus includes a platform 6 located between rails 4/4' of the lifting apparatus. A motor support mechanism 8, which may be referred to as a traction motor dolly rests between the rails 4/4'. When the rails 4/4' are aligned with rails 7/7' a rail car can be rolled onto the lifting apparatus such that a wheel assembly of the rail car can be removed. In order to facilitate removal, one or more jacks are used to support the rail car body in the area adjacent to the wheel assembly to be removed. Not shown in FIG. 1 is a secondary set of rails that are optionally parallel to rails 7/7' such that the lifting apparatus 2 can move along the floor tracks 80 to align with the secondary set of rails. One exemplary removal process includes positioning the rail car on the rails 4/4' and releasing the appropriate wheel assembly from the rail car. The rail car is supported by jacks or other supporting mechanisms that contact the rail car body or another location on the rail car. The rails 4/4' are lowered and the base 28 is moved along the floor tracks 80 to align with the secondary rails. The rails 4/4' are lifted and the wheel assembly is moved off the secondary rails in one direction. Along the other direction of the secondary rails, a new or repaired wheel assembly is moved over the rails 4/4' which are then lowered and moved into alignment under the rail car. Then the new or repaired wheel assembly is lifted into position and attached to the rail car. The secondary rails can also include an access passage similar to access passage 5.

The motor support mechanism 8 includes a block 18/18' that displaces vertically to support part of the wheel assembly. In order to remove wheel assemblies from rail cars, it is often required that the weight of a motor is supported so that bolts and fasteners can be removed. The pit 3 is designed to include an access passage 5 that may include stairs to allow a worker to access the platform 6 in order to release the wheel assembly from the rail car. The access passage 5 may be positioned between rails 7/7'. It is understood that in certain embodiments the rails 7/7' may be referred to as fixed rails.

The lifting apparatus two (2) includes lifting mechanisms positioned below platforms 42/42'. The lifting mechanism may include links 30/32 which are connected at a medial pivot. As shown, one link is connected to a fixed rotation connection 34 and the other link is on a sliding connection 20/22 that allows the support 20 to move relative to the rotating pivot 34. The sliding connection may be a linear bearing. On the opposite end of the links, there is a rotating pivot 34' and a sliding connection 20'/22'. Thus, each link as a rotating pivot on one end and a sliding connection on the other end such that relative movement of the sliding connections causes vertical displacement of the associated platform 42/42'. The movement of the lifting mechanisms is caused by a motor 24, screw 40 and screw block 41 combination along with a secondary linkage.

Figure 9:
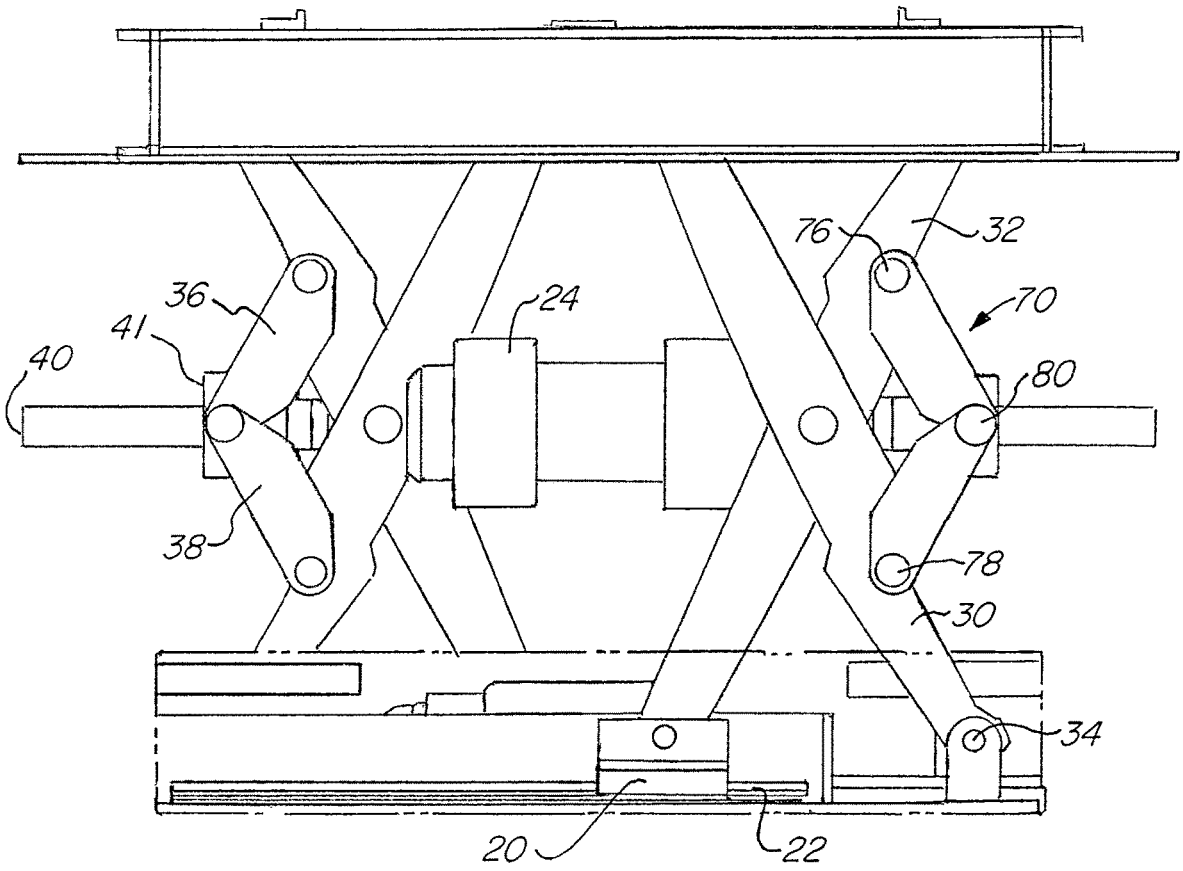
FIG. 9 is a side view of the lifting apparatus of FIG. 1.

The secondary linkage 70 (See FIG. 9 for a side view) includes two arms 36/38 that are joined to one of the links 30/32 at a medial pivot 78/76 such that a hinge 80 can be moved with respect to pivot 31' such that the links rotate with respect to each other as the distance between pivot 31' and hinge 80 changes, thereby causing vertical displacement of the rails 4/4' and the platform 42/42'.

Figure 2:
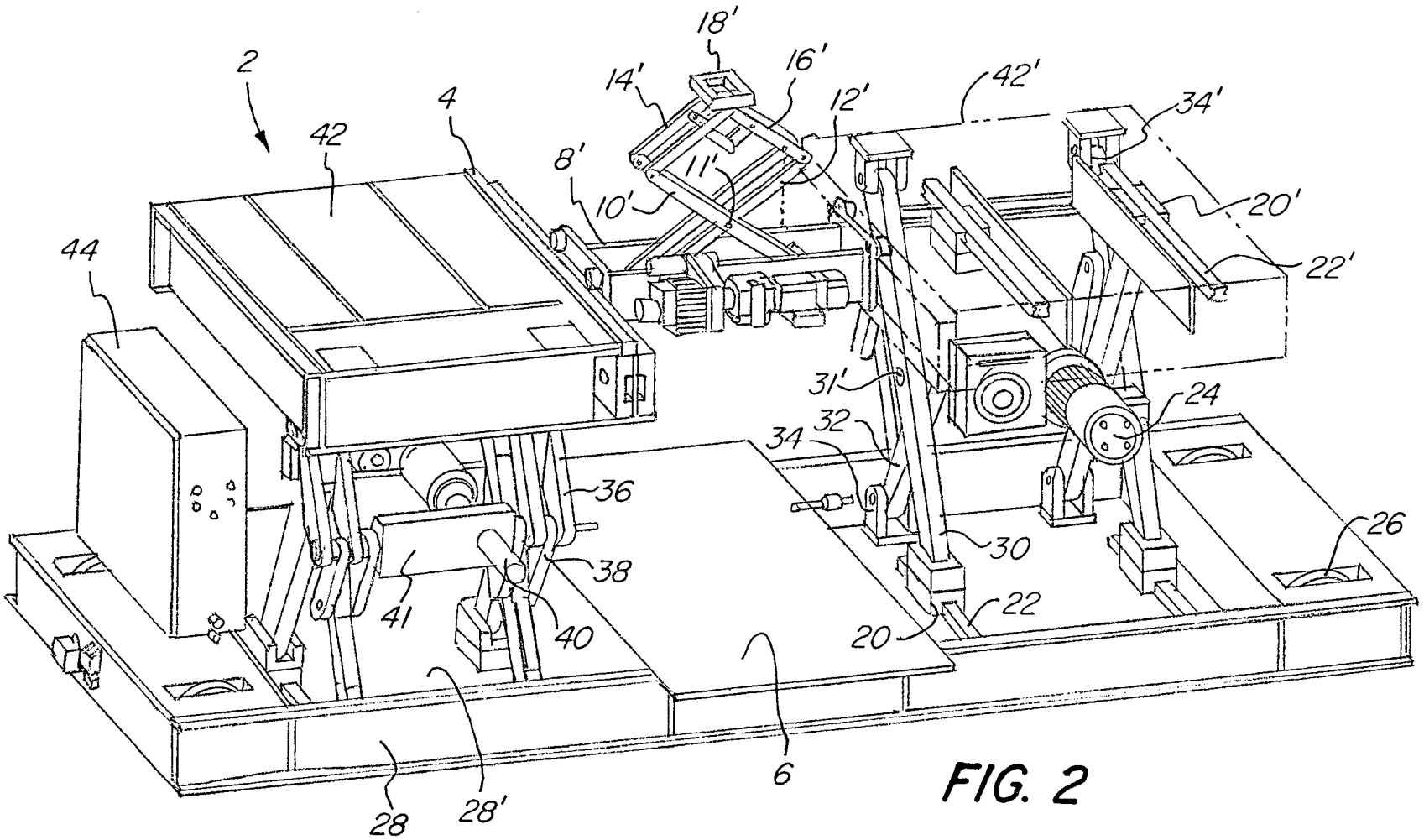
FIG. 2 is a perspective view of aspects of the lifting apparatus of FIG. 1 shown in a raised position.

The base 28 of the lifting apparatus includes wheels 26 that roll on a track that is located on the floor 82 which may be located in the pit 3. In FIG. 2, the apparatus is shown at maximum height and in FIG. 3, the apparatus is shown at minimum height. The difference in the maximum and minimum heights is the travel of the apparatus.

Figure 3:
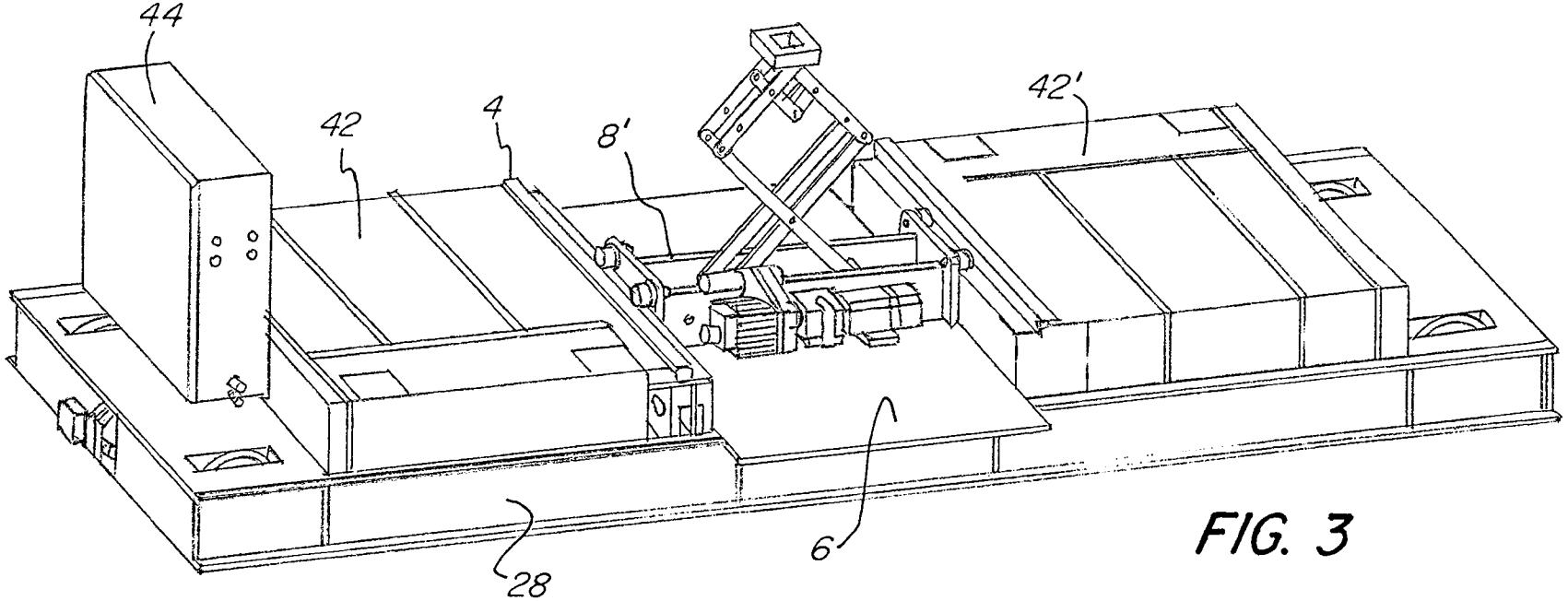
FIG. 3 is a perspective view of the aspects of the lifting apparatus of FIGS. 1 and 2 shown in a lowered position.

As can be seen in FIG. 3, the lifting mechanisms collapse upon themselves to allow for the minimum height to be relatively small compared to prior art drop tables. The motor, links, and arms all are designed to fit under the platform in the void defined between the base cavity 28' and the platform 42. Since the minimum height is relatively small, the pit depth can likewise be less than traditional drop tables. In some examples the minimum rail height is less than 50% of the depth. One preferable range of minimum rail height to depth is 50%-10%. Also, in some examples the total travel is greater than 62.5% of the depth. One preferable range of travel is 62.5%-90% of depth.

Figure 4:
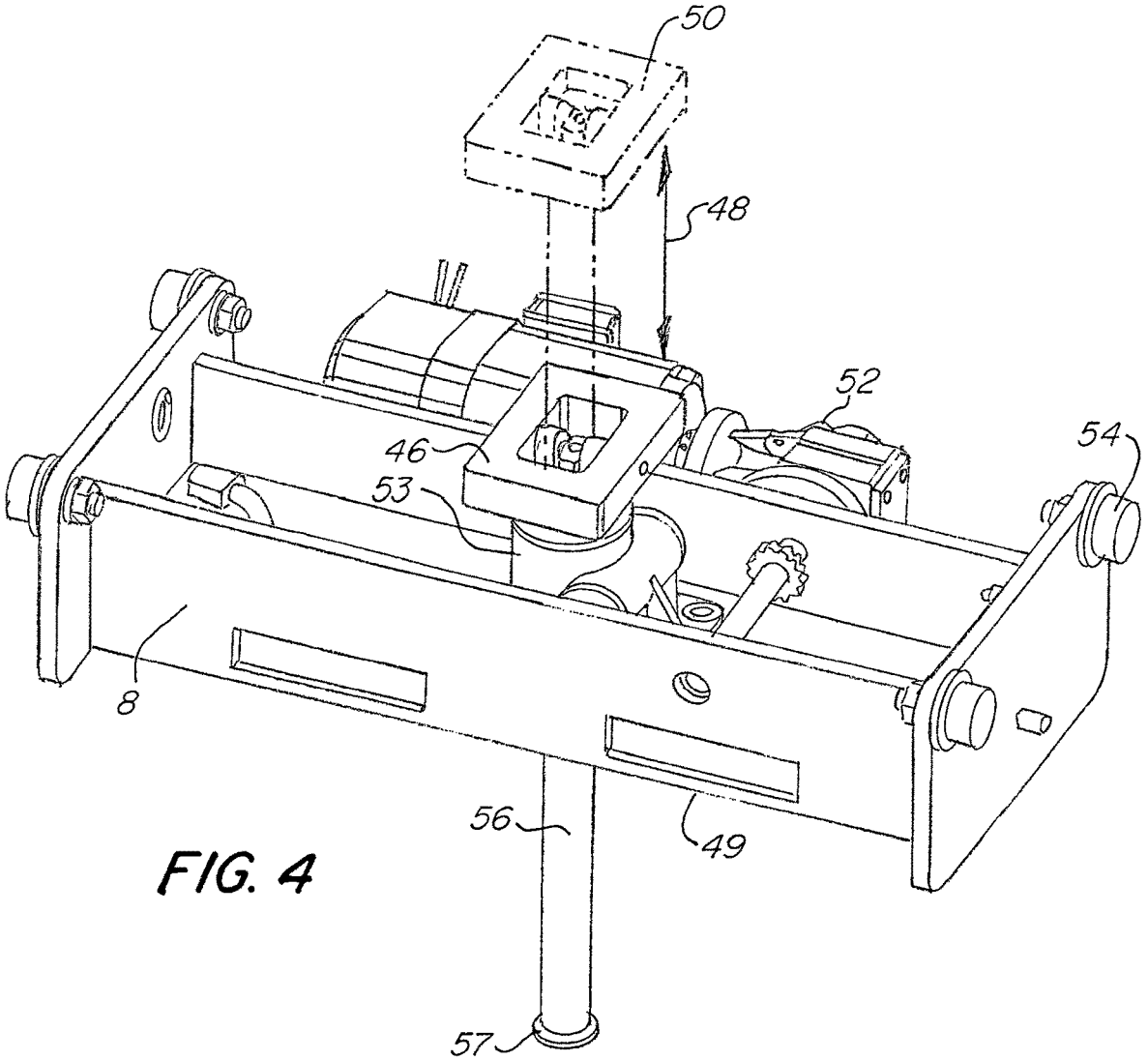
FIG. 4 is a perspective view of a support mechanism as shown in FIG. 1.

In FIG. 4 one motor support mechanism 8 is shown with a traveling screw. Column 56 moves through gearbox 53 which is driven by motor 52 to cause vertical displacement 48 of the column and thus the block 46. The column 56 may include a linear gear on one side and the gear box may have a round gear therein where the teeth of the linear gear and the round gear interlock such that rotation of the round gear causes vertical displacement of the column 56. It is also understood that threads may be used to cause vertical displacement of the column 56 as would be apparent to one of skill in the art. In the upper position 50, the bottom end of the column 57 is approximately level with the bottom of the support 49. When the platforms 40/42 are lowered, the column is placed in the upper position 50 to avoid interference with the lower end 57 and the platform 6. This further allows the minimum height of the lifting apparatus to remain relatively small and thus allow for a relatively shallow pit depth. In some cases, the lower end 57 hangs below the bottom of the support 49 at a distance such that it does not interfere with the platform 6 when the lifting apparatus is at the minimum height. Interference could cause wheels 54 to come out of contact with the platform 42/42'.

Figure 5:
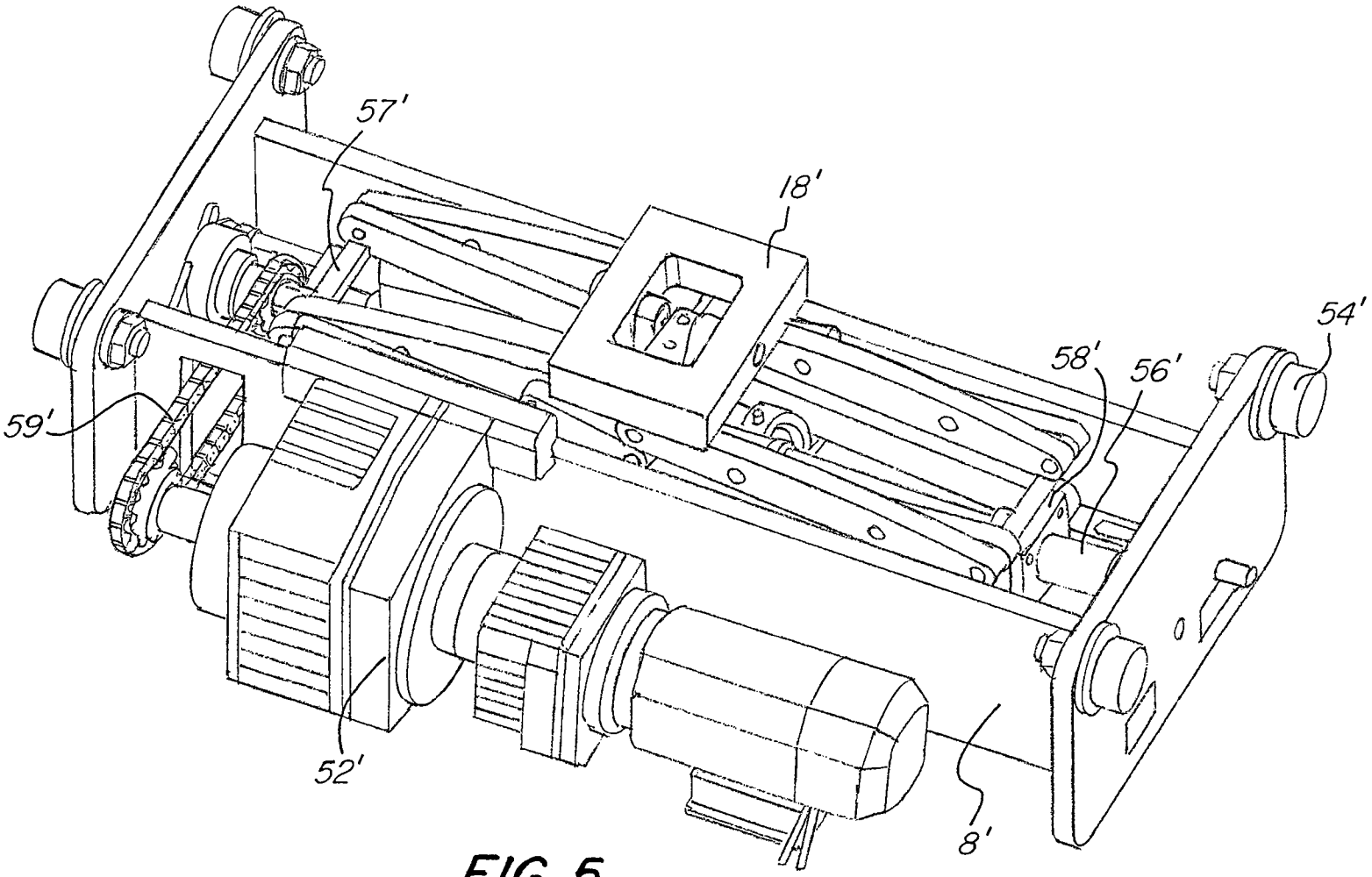
FIG. 5 is a perspective view of a support mechanism which may fit between the tracks of the lifting apparatus shown in FIG. 1.
Figure 6:
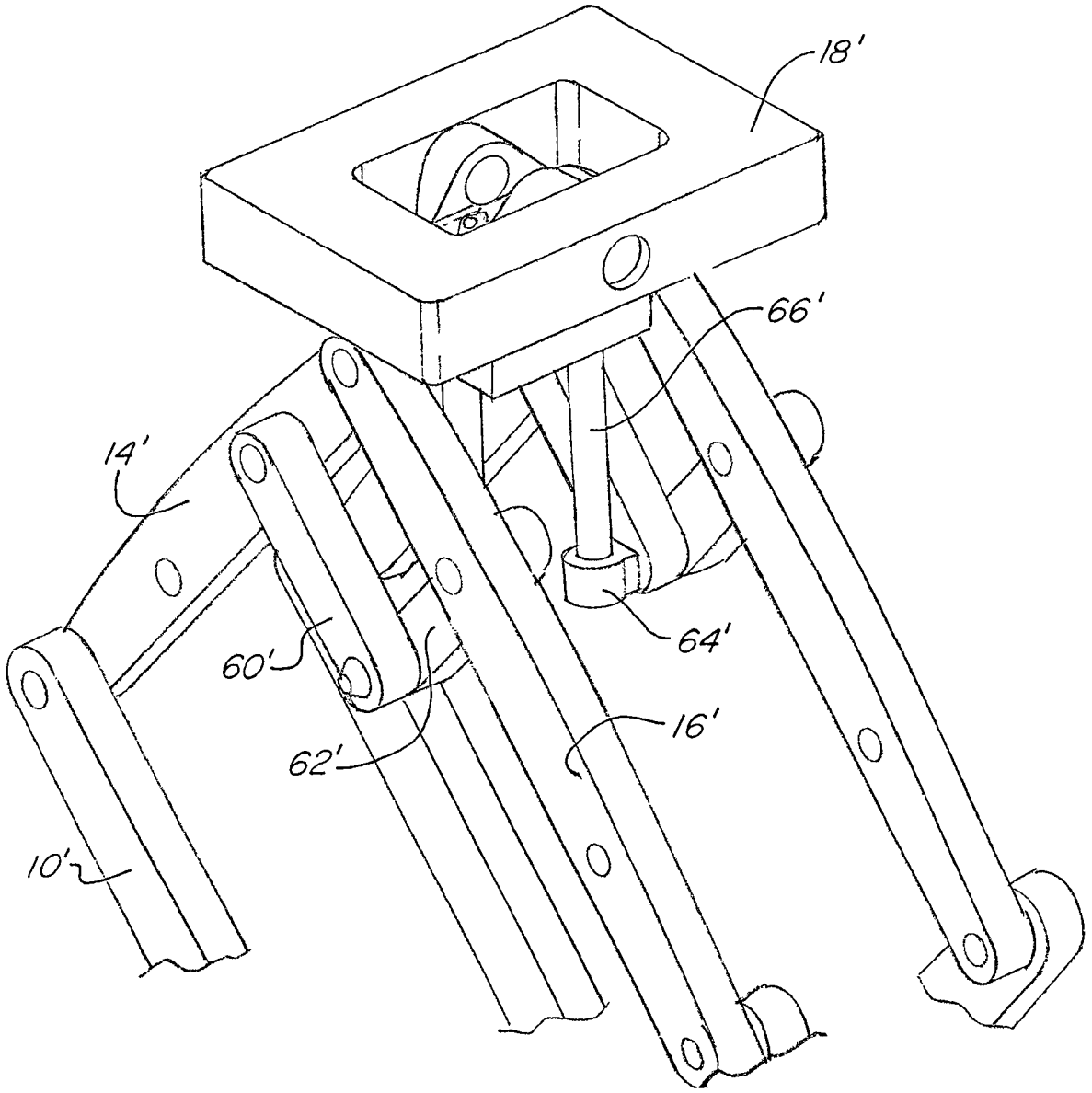
FIG. 6 is a detail perspective view of the support mechanism of FIG. 5 shown in an upper position.

FIGS. 5 and 6 show an alternate embodiment of the motor support mechanism 8'. In this embodiment, screw 56' has two threaded blocks 57'/58' threaded therearound such that rotation of the screw 56' causes the distance between the threaded blocks 57'/58' to change. This change in distance in turn causes vertical displacement of block 18'. The screw may be rotated by motor 52' and chain 59'. The threaded blocks 57'/58' are connected to support links 10712' and the support links 10712' are connected to each other at connection 11'. Links 14' and 16' are connected to ends of links 10' and 12' respectively. Links 60' and 62' are connected to each other on one end and respectively to links 14' and 16' on their respective other ends. Sliding joint 64' and column 66' resist rotation of block 18' if a load is off center on the block 18'. The column 66' slides within sliding joint 64' as the block 18' moves up and down The support mechanism may include two support links 10'/12' that are connected to threaded blocks Often upon removal a jack stand is placed under the rail car. The support mechanism hangs on the platforms 42/42' with wheels 54 so that the support mechanism may be positioned under the wheel assembly at the appropriate location for removal of the wheel assembly.

Figure 7:
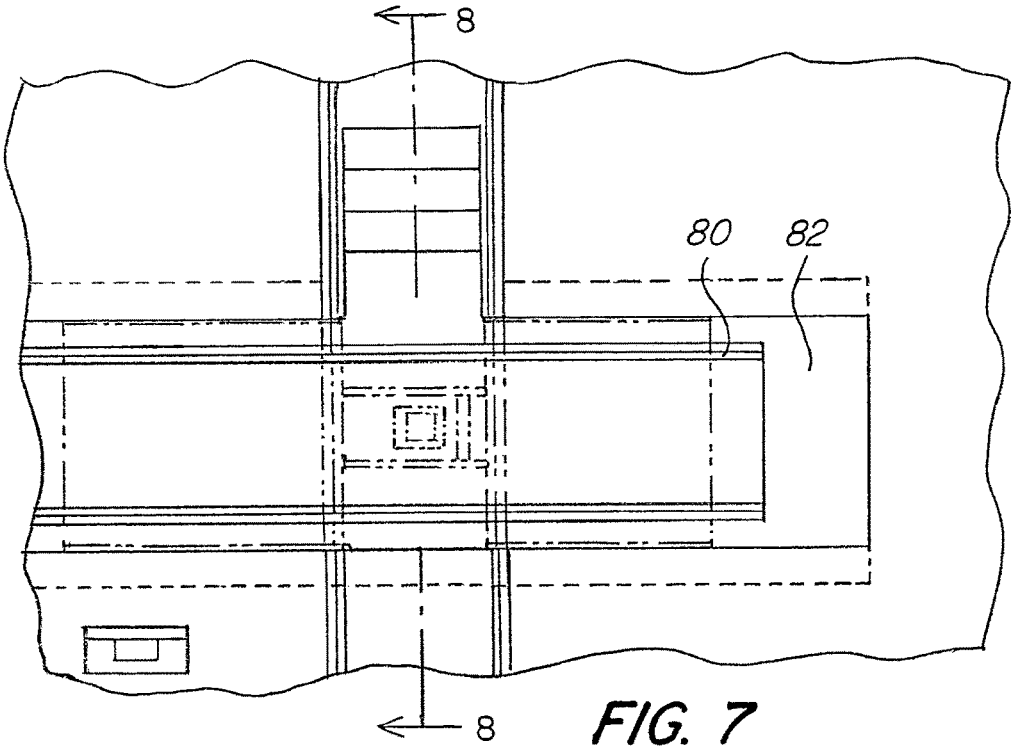
FIG. 7 is a partial top view of the lifting apparatus of FIG. 1
Figure 8:
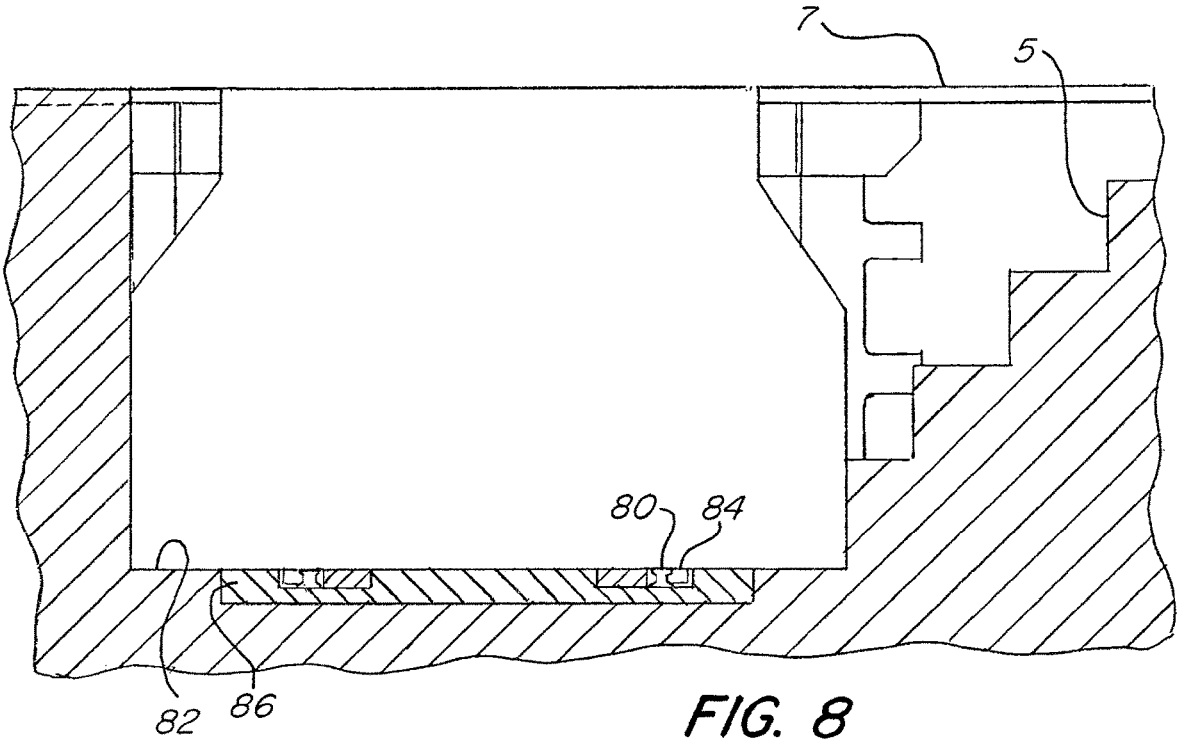
FIG. 8 is a section view along section line 8-8 as shown in FIG. 7.

In FIGS. 7 and 8, the floor tracks 80 are shown in additional detail. The floor 82 of the pit or foundation. As shown, the floor tracks 80 are approximately level with the floor 82. The floor tracks may be built into an embedment 86 which is sunk into the foundation. Part of the wheels 26 may extend below the floor 82 into gap 84. By recessing the floor tracks 80 in the floor 82, additional pit depth is saved as prior art designs would usually require mounts positioned on the floor and a track located on top of the mounts. Thus the floor in prior art designs would typically be located below the top of the tracks.

In one embodiment a pit depth of six (6) feet or less may be used where pit depth may be measured between the top of the rails 7/7' and the floor 82. The travel of the drop table as measured between minimum rail height (height of rail 4 as shown in FIG. 3) and maximum rail height (height of rail 4 as shown in FIG. 2) may be in the range of 40-60 inches. A travel::depth ratio may be defined as (travel/pit depth). In some cases travel::depth may be greater than 50%, greater than 55%, and/or in the range of 50%-85%. A minimum height::depth ratio may be defined as (minimum height/pit depth). In the example shown in FIG. 3, the minimum rail height may be two (2) feet. In some cases, a minimum height::depth ratio may be less than 50%, less than 40%, less than 33%. In one embodiment the minimum height::depth ratio is in the range of 50%-10%. In the example of FIG. 3, a clearance can be measured between the minimum rail height and the platform. The clearance will typically be equal or greater than the distance which the bottom of the motor support mechanism 8/8' hangs below the rails 4/4'. For example, the bottom may be measured at bottom surface 49 when column 56 is in an upwards position. In some cases, the bottom may be measured as the bottom surface of the bottom of the column 57. As can be seen in the motor support mechanism 8, the column is movable to minimize the overhang and thus fit within the clearance. Motor support mechanism 8' is designed so that the bottom hangs below the rails less than or equal to the clearance to enable the lifting mechanism to reach a minimum position while the motor support mechanism 8 remains in contact with the platform.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A lifting apparatus located in a pit comprising:

two rails spaced apart at a distance, the two rails configured to receive a railway car thereon;

two lifting mechanisms, each lifting mechanism including a motor, each one of said two lifting mechanisms supporting and moving only one of the two rails;

a base, said two lifting mechanisms connected to said base and movement of at least one of said lifting mechanisms causes at least one of said two rails to displace relative to said base;

a depth measured from a floor to a top of a fixed rail is six feet or less and wherein the fixed rail is located above the floor and the fixed rail is configured to receive the railway car thereon, the floor being a bottom floor of the pit;

a minimum rail height measured as a distance between the floor and a top of at least one of said two rails when said two rails are at a bottom position;

a maximum rail height measured as a distance between the floor and a top of at least one of said two rails when said two rails are at a top position;

a travel defined as a difference between said maximum and minimum rail heights;

wherein said travel is greater than 50% of said depth;

wherein said minimum rail height is less than 50% of said depth;

wherein said two lifting mechanisms are located entirely below said two rails in both the bottom and top positions of said two rails; and wherein said two lifting mechanisms each comprises:

two links comprising first and second links joined to each other in a medial section by a first pivot; and a rotating pivot located at one end of each of said two links, another end of each of said two links having a sliding connection such that rotation of said two links about their respective rotating pivots causes the sliding connections to move relative to the rotating pivots to cause vertical displacement of said first pivot;

a secondary linkage comprising two arms joined at a first hinge on one end and each rotatably connected to one of the two links at their respective other ends; and a linear displacement device connected to the first pivot and the first hinge by two blocks such that a first of the two blocks aligns with the first hinge and a second of the two blocks aligns with the first pivot such that displacement of the linear displacement device causes a distance measured between the first hinge and the first pivot to change to thereby raise or lower the platform.

2. The lifting apparatus of claim 1, wherein said two rails each define a top surface and further comprising:

two lower surfaces located below and between the top surfaces;

a support extending between said two lower surfaces;

a support mechanism connected to said support on one end, said support mechanism moving between extended and retracted positions to cause vertical displacement of another end of the support mechanism in relation to the support.

3. The lifting apparatus of claim 2 wherein said support mechanism comprises:

a column;

a gearbox rotatable by a drive wherein rotation of said gearbox causes vertical displacement of said column; a first distance measured vertically between a top surface of at least one said two rails and said platform when said lifting mechanism is in a lowered position;

said column dimensioned such when said column is in a first position a lower end of said column extends below said two rails at a second distance less than said first distance.

4. The lifting apparatus of claim 3 further comprising: a track positioned below said base such that said base moves along said track positioned in a pit;

wherein said track is recessed into the floor such that wheels associated with the base extend at least partially below the floor.

5. The lifting apparatus of claim 2, wherein said support mechanism comprises:

a threaded member rotatable by a drive;

said threaded member having two threaded blocks threaded therearound such that rotation of said threaded member causes a distance between the two threaded blocks to change;

two support links, each support link rotatable about one of the two threaded blocks;

the support links connected to each other at a medial portion of the support links such that displacement of the threaded blocks causes the support links to rotate in opposing directions;

a block mechanism connected to a block at one end and connected to the support links such that rotation of the support links causes vertical displacement of the block.

6. The lifting apparatus of claim 5, wherein said block mechanism further comprises:

third and fourth support links connected to the block at the one end of said block mechanism and each connected to one end of one of the two support links;

fifth and sixth support links respectively connected to the third and fourth support links and rotatable with respect to each other at a rotation connection;

a column extending from the block to a sliding joint, the sliding joint coupled to the rotation connection such that vertical displacement of the block causes said column to slide within the sliding joint.

7. The lifting apparatus of claim 5 further comprising: a track positioned below said base such that said base moves along said track positioned in a pit;

wherein said track is recessed into the floor such that wheels associated with the base extend at least partially below the floor.

8. The lifting apparatus of claim 1 further comprising:

a track positioned below said base such that said base moves along said track positioned in the pit;

wherein said track is recessed into the floor such that wheels associated with the base extend at least partially below the floor.

9. The lifting apparatus of claim 1, wherein said travel is greater than 62.5% of said depth.

* * * * *